US007779640B2

(12) United States Patent
Price et al.

(10) Patent No.: US 7,779,640 B2
(45) Date of Patent: Aug. 24, 2010

(54) LOW VIBRATION CRYOCOOLER

(75) Inventors: Kenneth D. Price, Long Beach, CA (US); Robert C. Hon, Playa Del Rey, CA (US); Julian A. Shrago, Garden Grove, CA (US); Michael C. Barr, Torrance, CA (US); Michael H. Kieffer, Redondo Beach, CA (US); Michael J. Ramirez, Torrance, CA (US)

(73) Assignee: Raytheon Company, Waltham, MA (US)

( * ) Notice: Subject to any disclaimer, the term of this patent is extended or adjusted under 35 U.S.C. 154(b) by 429 days.

(21) Appl. No.: 11/223,518

(22) Filed: Sep. 9, 2005

(65) Prior Publication Data

US 2007/0056297 A1 Mar. 15, 2007

(51) Int. Cl.
*F25B 9/00* (2006.01)

(52) U.S. Cl. ..... 62/6; 318/128; 318/122; 60/520

(58) Field of Classification Search ..... 62/295, 62/6; 250/352; 60/250; 318/122, 128
See application file for complete search history.

(56) References Cited

U.S. PATENT DOCUMENTS 4,389,849 A * 6/1983 Beggs et al. ..... 62/6
4,475,346 A 10/1984 Young et al.
4,610,143 A * 9/1986 Stolfi et al. ..... 62/6
5,018,357 A * 5/1991 Livingstone et al. ..... 62/6
5,412,951 A * 5/1995 Wu ..... 62/6
5,678,409 A * 10/1997 Price ..... 62/6
6,131,394 A 10/2000 Lavietes et al.

FOREIGN PATENT DOCUMENTS

| | | | |
|---|---|---|---|
| GB | 2 318 887 | A | 5/1998 |
| JP | 02 217757 | A | 8/1990 |
| JP | 06 074588 | A | 3/1994 |
| JP | 08 005178 | A | 1/1996 |
| JP | 11 006658 | A | 1/1999 |

* cited by examiner

*Primary Examiner*—Cheryl J Tyler
*Assistant Examiner*—John F Pettitt
(74) *Attorney, Agent, or Firm*—Pillsbury Winthrop Shaw Pittman LLP

(57) ABSTRACT

Disclosed are a low vibration cryocooler and a method of reducing vibration in a cryocooler. The cryocooler can be a Stirling class cryocooler includes at least one motor that drives a mass, the motor having a main drive winding and a separate trim winding. A motor controller outputs a main drive signal that is coupled to the main drive winding and a separate vibration reducing signal that is coupled to the trim winding.

28 Claims, 2 Drawing Sheets

LOW VIBRATION CRYOCOOLER

TECHNICAL FIELD

The present invention relates generally to a cryocooler and, more particularly, to a cryocooler implemented to have low vibration.

BACKGROUND

Cryogenic coolers are used to cool devices, such as an infrared detector of a spacecraft, to cryogenic temperatures between about 40 degrees Kelvin to about 80 degrees Kelvin. For this purpose, a Stirling cycle expander is often used. Such a cryocooler can form part of a multi-stage cryocooler, also termed a two-stage expander, having a Stirling expander and a pulse tube expander. Examples of these systems are disclosed in U.S. Pat. Nos. 5,392,607, 5,412,951, 5,680,768, 6,167,707 and 6,330,800, the disclosures of which are incorporated herein by reference in their entireties.

Conventional cryocoolers include a motor used to drive a piston or displacer. Such motion can result in vibration of the cryocooler that can, in turn, disrupt operation of the cooled item. For example, when the cooled item is an optical detector system, such as a system that includes optics and/or a focal plane array, the performance degradation due to vibration attributable to the cryocooler module can reach unacceptable levels.

Attempts to limit the amount of vibration have included using dual opposed motors with an active vibration feedback and cancellation system. In this arrangement, the motors are placed in opposed orientations such that the moving mass driven by each motor is accelerated in opposite direction using, in an ideal implementation, identical forces. If the system is ideal, the net fore experienced by the cryocooler module would be zero.

Unfortunately, in practice, the dual opposing motor suffers from imperfections and/or inequalities in the motors, moving masses, suspension system stiffness and so forth. As a result, the cryocooler module experiences a non-zero total force and unacceptable levels of vibration can result. Therefore, the dual-opposed motor solution has been supplemented with an active feedback system. In that system, the net vibration output of the cryocooler module is sampled. For instance, load washers are placed in the load path between the cryocooler module and a mounting bracket and the load washers are used to detect the vibration of the cryocooler and provide a corresponding electrical signal. This signal is processed to produce a digital vibration-canceling waveform (or vibration trim signal) that is combined with (i.e., added to) a digital temperature control signal. The combined signal is amplified with a pulse width modulated (PWM) amplifier and the motor is driven in accordance with the amplified, combined signal.

The foregoing feedback control solution is limited by the minimum motor current that can be commanded as determined by the least significant bit available from the processor/servo loop. More particularly, the trim signal is much smaller in magnitude than the temperature control signal, which represents the motor's main drive parameter. Since the signal path leading to the main drive amplifier is of limited resolution, the relatively small trim signal is represented at best by a few of the combined signal's least significant bits. Therefore, the trim signal component of the signal delivered to the amplifier is very "rough" and an upper limit of its effectiveness to counter vibration is quickly encountered since the force required for vibration cancellation is smaller that what can be accurately represented in the signal path leading to the drive amplifier. For example, if the desired motor current is represented at the input to the amplifier as a twelve bit signal, the maximum possible number of discrete steps is 4096. If the maximum current for the example is ten amperes, then the current resolution that can be applied to the motor is 2.44 mA. If the typical force constant for the motor in the example is fourteen Newtons per Ampere (N/A), then the force resolution is about 34.16 milliNewtons (mN) (i.e., 2.44 mA times 14 N/A equals 0.03416 Newtons). As a result, vibration cannot be effectively controlled with any finer resolution than changing the force in steps of about 34 mN.

Vibration control using the foregoing solution is further hampered by other factors. For example, while PWM amplifiers are used for efficiency, they typically exhibit relatively high amounts of total harmonic distortion (THD) that can interfere with fine trim signals used for low-level vibration regulation. Also, if the number of time steps associated with each on/off period of the PWM amplifier is not sufficiently high enough, the resolution of the vibration cancellation can be degraded. Additionally, power MOSFETs used in an output section of the PWM amplifier have a fairly long turn-on time with respect to the duty cycle time step size, which can lead to non-negligible crossover distortion.

Accordingly, there is a need in the art for a cryocooler with improved vibration characteristics.

SUMMARY OF THE INVENTION

According to one aspect of the invention, a Stirling class cryocooler includes at least one motor that drives a mass, the motor having a main drive winding and a separate trim winding; and a motor controller that outputs a main drive signal that is coupled to the main drive winding and a separate vibration reducing signal that is coupled to the trim winding.

According to another aspect of the invention, a method of reducing vibration in a Stirling class cryocooler having at least one motor that drives a mass includes generating a main drive signal and coupling the main drive signal to a main drive winding of the motor; and generating a vibration reducing signal separate from the main drive signal and coupling the vibration reducing signal to a trim winding of the motor that is separate from the main drive winding.

BRIEF DESCRIPTION OF DRAWINGS

These and further features of the present invention will be apparent with reference to the following description and drawings, wherein.

DESCRIPTION

Figure 1:
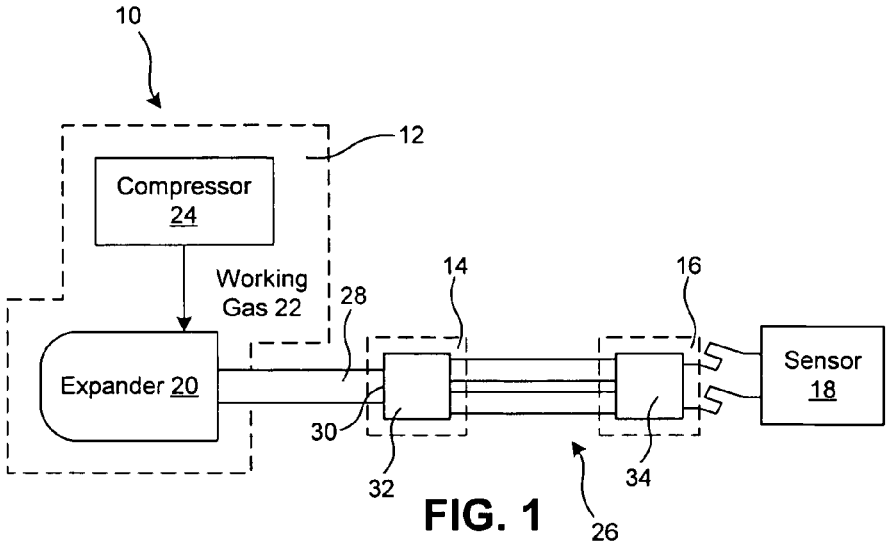
FIG. 1 is a schematic diagram of a cryocooler in accordance with the present invention.

In the description that follows, like components have been given the same reference numerals, regardless of whether they are shown in different embodiments. To illustrate an embodiment(s) of the present invention in a clear and concise manner, the drawings may not necessarily be to scale and certain features may be shown in somewhat schematic form. Features that are described and/or illustrated with respect to one embodiment may be used in the same way or in a similar way in one or more other embodiments and/or in combination with or instead of the features of the other embodiments.

The present invention will be described in the context of reducing vibration of a Stirling class cryocooler used to cool optical components and sensors of a spacecraft. For example, the cooled devices can be an actively cooled cryogenic infrared (IR) sensor, an optical instrument, a focal plane or similar item. It will be appreciated, however, that cooled item can be any item in need of cryogenic cooling. It will be further appreciated that vibration originating from other types of linearly oscillating masses may be reduced in a manner consistent with the vibration reduction techniques described herein.

The cryocooler described herein includes an expander module and a compressor module, each of which includes at least one motor to drive a mass and each of which individually generates vibration. The vibration reducing techniques described herein can be applied to one or both of the expander module and the compressor module. For illustrative purposes, the invention is described in the context of reducing vibration of the expander module. However, it will be appreciated that the invention can be applied to reducing vibration of the compressor module in addition to or instead of reducing vibration of the expander module using the same or similar techniques and principles, but separately applied to the compressor module.

Referring to FIG. 1, generally illustrated is a two stage cryocooler 10, also termed a two-stage expander. Examples of these systems also are disclosed in U.S. Pat. Nos. 5,392,607, 5,412,951, 5,680,768, 6,167,707 and 6,330,800, the disclosures of which are incorporated herein by reference in their entireties.

The cryocooler 10 includes an ambient temperature portion 12, a first-stage temperature portion 14, and a second-stage temperature portion 16. The second-stage temperature portion 16 is coupled to a component to be cooled, such as a sensor 18. The first-stage of the cryocooler 10 includes a Stirling expander 20 for providing cooling by expanding a working gas 22 compressed by a compressor 24. The second stage of the cryocooler 10 is a pulse tube expander 26. The mechanical structure and operation of the cryocooler 10 will be apparent to one of ordinary skill in the art and, therefore, will only be briefly described herein.

In an outline of general operation of the system, the compressor 24 supplies the compressed working gas 22, such as helium, to the cryocooler 10. Initially, working gas 22 is supplied to the first-stage Stirling expander 20. The working gas 22 is expanded into an expansion volume 28. The working gas 22 flows from the expansion volume 28 through a Stirling expander outlet 30, through a first-stage interface 32, and into the second-stage pulse tube expander 26. A second-stage thermal interface 34 is provided between the second-stage pulse tube expander 26 and a heat load in the form of the component to be cooled, such as the sensor 18.

Figure 2:
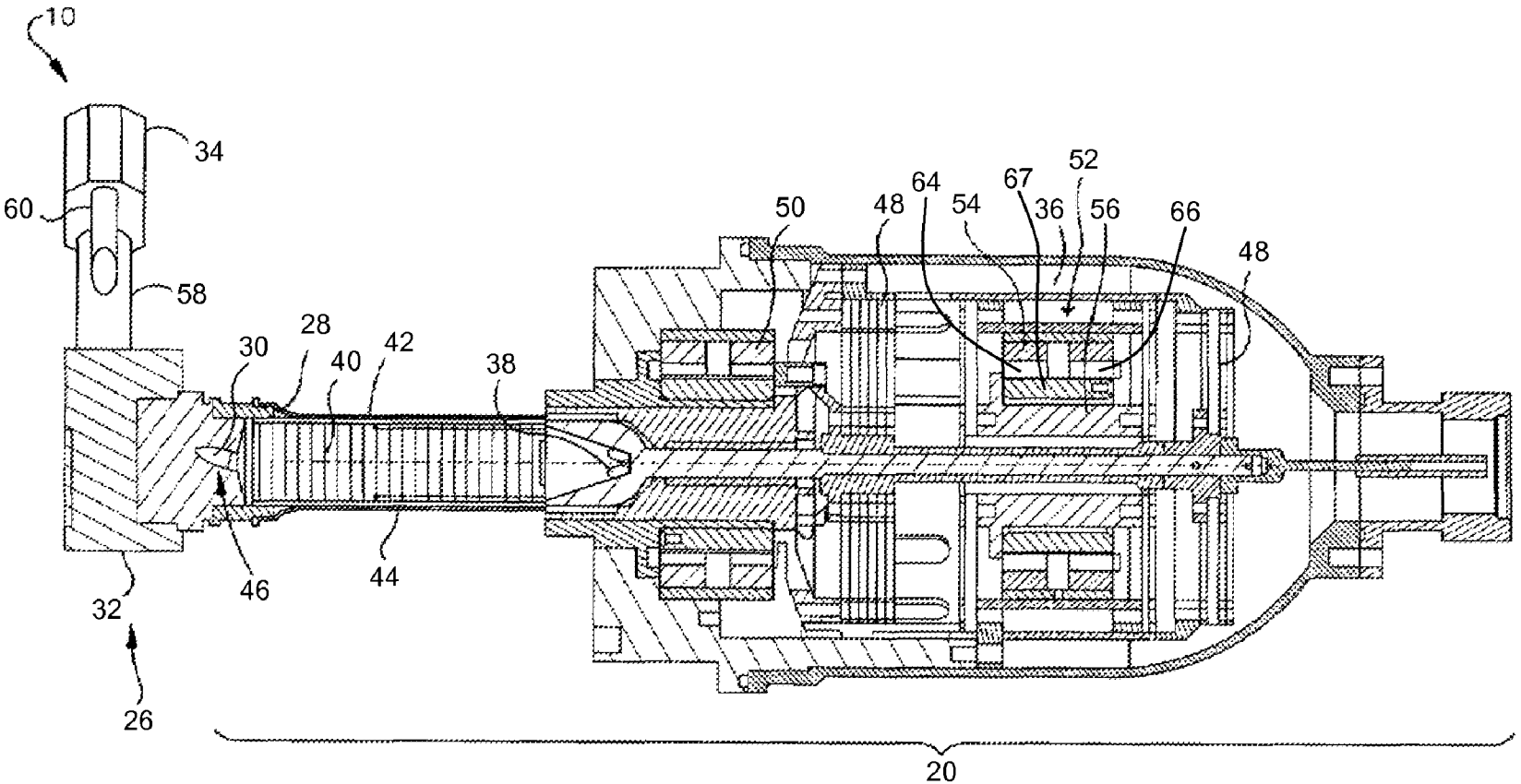
FIG. 2 is a more detailed schematic view of the cryocooler with a Stirling expander stage shown in section.

With additional reference to FIG. 2, some details are shown of the structure of the Stirling expander 20 and the second-stage pulse tube expander 26. The Stirling expander 20 has a plenum 36 and a cold head that includes a thin-walled cold cylinder, an expander inlet 38 disposed at a warm end of a first-stage regenerator 40, a moveable piston or displacer 42 disposed within a cold cylinder 44, and a heat exchanger 46. The displacer 42 is suspended on flexures 48. The displacer 42 is controlled and moved by using a motor 50 located at a fore end of the plenum 36.

A flexure-suspended balancer 52 may be used to provide internal reaction against the inertia of the moving displacer 42. The balancer 52 may include, for example a motor 54 used to drive a moving mass 56.

The second-stage pulse tube expander 26 includes a second-stage regenerator (regenerative heat exchanger) 58, and a pulse tube 60. The second-stage regenerator 58 and the pulse tube 60 are gaseously coupled at one end to the second-stage interface 34. Both the second-stage regenerator 58 and the pulse tube 60 are physically connected to the first-stage interface 32 at an opposite end, but are not in direct communication with each other. The first-stage interface 32 has a port that is connected to a second-stage outlet.

In operation of the cryocooler 10, a gas, for instance helium, flows into the expander inlet 38, and into the first-stage regenerator 40 and the heat exchanger 46. Gas flowing into the cold volume within the expander 20 is regenerated by the first-stage regenerator 40. A portion of the gas remains in the first-stage expansion volume of the first stage regenerator 40. Progressively smaller portions of the gas continue to the second-stage regenerator 58, the pulse tube 60 and a surge volume (not shown). The gas return flow follows the same path in reverse.

Figure 3:
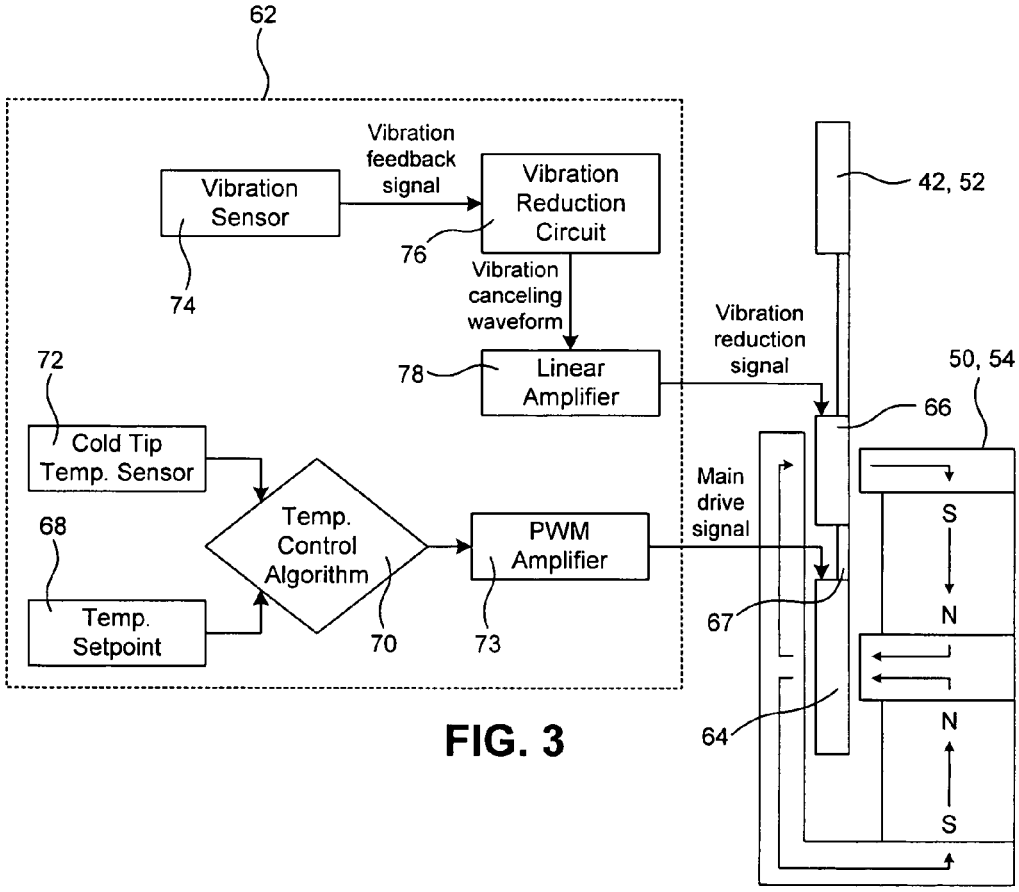
FIG. 3 is a schematic block diagram of a control circuit for one or more motors of the cryocooler expander.

With additional reference to FIG. 3, shown is a schematic block diagram of a control circuit 62 for the motor 50 and/or the motor 54 of the balancer 52. In one embodiment, the control circuit 62 is used to control operation of the motor 50 to effectuate cooling of the device to be cooled, such as the sensor 18 (FIG. 1) and a separate control circuit can be used to control operation of the motor 54. In another embodiment, the control circuit 62 is used to control operation of the motor 54 to effectuate balancing of the motor 50 and displacer 42 and a separate control circuit can be used to control operation of the motor 50. In these embodiments, the separate control circuit can be configured to be identical to or different than the control circuit 62. In a preferred embodiment, the control circuit 62 supplies a main drive signal to each of the motors 50, 54 such that main drive currents respectively applied to each motor 50, 54 are substantially similar, if not the same, and the control circuit 62 supplies a trim current for adaptively reducing vibrations to one of the motors 50, 54.

The motor 50, 54 receiving the vibration reducing trim current can have a main drive winding (or coil) 64 and a separate trim winding (or coil) 66. The windings 64, 66 are separately driven by the control circuit 62. Alternatively, both of the motors 50, 54 can include a trim winding 66. In general, the drive windings 64 of the motors 50, 54 are driven so that the motor 50 operates the cryocooler 10 to cool the device to be cooled (e.g., sensor 18) and the motor 54 operates to balance the operation of the motor 50. The trim winding 66, present in at least one of the motors 50, 54, is driven to reduce vibration of the cryocooler 10.

The trim winding 66 can be arranged with respect to the main drive winding 64 in a number of manners. For example, and as illustrated, the trim winding 66 and the main drive winding 64 can each have their own magnetic gaps with respect to the rest of the motor 50, 54, even if the windings 64, 66 are wound on a common bobbin. Using separate magnetic gaps for the windings 64, 66 can minimize inductive coupling between the windings 64, 66. In another example, the trim winding 66 can be wound directly on top of or under the main drive winding 64, such as on the same bobbin. In both arrangements, each winding 64, 66 has its own set of electrical leads and magnetic poles in which to operate.

Mechanically, the windings 64, 66 do not operate independently. Rather, the windings 64, 66 are physically linked together and can operate on the same mechanical mechanism. For example, the windings 64, 66 can be connected by a linkage 67, such as a bobbin common to both windings 64, 66. The windings 64, 66, or more specifically, a member connected to the windings 64, 66 (e.g., a bobbin) can be physically connected to drive the displacer 42 or the balancer 52.

In conventional Stirling expanders 20 two discrete metallic flexure stacks are used as conductors through which a motor drive signal (e.g., motor drive current) is routed. With the addition of the trim winding 66, four electrically isolated flexure stacks can be provided.

To generate the main drive signal, a temperature set point value 68 corresponding to a desired temperature of the device to be cooled, such as the sensor 18, can be established and input to a temperature control algorithm 70. The temperature control algorithm 70 can be embodied as executable instructions (e.g., software) having functionality carried out by a general purpose processor or dedicated purpose processor. Alternatively, the temperature control algorithm 70 can be embodied in electrical circuit components arranged to carried out a specified logic routine.

The temperature control algorithm 70 can monitor the relationship of the temperature set point value 68 and an output of a temperature measuring device, such as a cold tip temperature sensor 72, used to determine the temperature at a known location. Based on the measured and desired temperatures, the temperature control algorithm 70 can output a signal corresponding to a desired amount of cooling from the cryocooler 10. For instance, the signal output from the temperature control algorithm 70 can be a digital representation of the amount of electrical power that should be applied the motor 50, 54.

The signal output by the temperature control algorithm 70 can be amplified by a pulse width modulation (PWM) amplifier 73 to convert the signal to the main drive signal. In one embodiment, the main drive signal is directly or indirectly applied to the main drive winding 64 to actuate the motor 50, 54.

In one embodiment, the signal output by the temperature control algorithm 70 can be a twelve bit digital value, which represents 4,096 possible commands or current steps for the main drive signal. The current applied to the motor 50, 54 can range from zero amps to about ten amps, or 2.44 mA per current step. If the force constant is about 14 Newtons per Amp (N/A), then each current step of the main drive signal can correspond to about 34 mN of force.

To generate the vibration reduction signal, a representation of the vibration of the expander 20 can be generated by a vibration sensor 74, such as a load cell or load washer placed in a load path between the expander 20 and a mounting bracket. The vibration sensor 74 can sample the net vibration of the expander 20 and generate an output signal, referred to as a vibration feedback signal. The vibration feedback signal, which can be an analog or digital signal, can be input to a vibration reduction circuit 76, also referred to as a trim circuit. If the vibration feedback signal is an analog signal, the vibration reduction circuit 76 can convert the analog signal to a digital signal for processing.

The vibration reduction circuit 76 can carry out logical operations to generate an appropriate output signal from the vibration feedback signal to effectuate a reduction in the amount of vibration of the cryocooler 10. In one embodiment, the circuit 76 can carry out adaptive feed forward (AFF) processing of the vibration feedback signal. The circuit 76 can be embodied as a processor for executing logical instructions and/or as discrete circuit components. In one embodiment, logical instructions (e.g., software) to carry out the function of the vibration reduction circuit 76 and the temperature control algorithm 70 can be executed by the same processor. In this embodiment, the processor outputs separate signals, one for generating the main drive signal and one for generating the vibration reduction signal. If appropriate, the signal output by the vibration reduction circuit 76 can be converted from a digital signal to an analog signal.

The output of the vibration reduction circuit 76 represents an amount of increased or decreased motor operation that is intended to reduce the vibration of the motor 50, 54 and can be considered to be a vibration canceling waveform. The output of the vibration reduction circuit 76 can be input to a linear amplifier 78, such as an analog class A or class A/B amplifier. The amplifier 78 amplifies the vibration-canceling waveform output from the vibration reduction circuit 76 to generate the vibration reduction signal. In one embodiment, the vibration reduction signal is directly or indirectly applied to the trim winding 66. The electrical power applied to the trim winding 66 acts to "tweak" the operation of the motor 50, 54 by adding to or countering the driving force of the main drive signal applied to the main drive winding 64. The vibration reduction signal will increase motor 50, 54 operation when the vibration reduction signal is positive relative to the main drive signal and decrease motor 50, 54 operation when the vibration reduction signal is negative relative to the main drive signal.

In one embodiment, the signal output by the vibration reduction circuit 76 can have a resolution such that, after amplification by the amplifier 78, the vibration reduction signal has a step size of about 0.043 mA. If the force constant is about 14 N/A, then each current step of the vibration reduction signal can correspond to about 0.6 mN of force for a ratio of about 1:0.017 with the current step of the main drive signal. In one embodiment, the ratio of the current step size of the main drive signal to the current step size of the vibration reduction signal can be in the range of about 1:0.005 to about 1:0.1. In this manner, the operation of the motor 50, 54 can be controlled with precision to effectuate fine control over vibration reduction with relatively low power consumption. Vibration reduction challenges presented by use of a PWM amplifier, such as THD, amplifier resolution and crossover distortion, are avoided.

By using the vibration reduction signal to trim the vibration of a component or components of the cryocooler 10, a two to three order of magnitude vibration reduction over conventional vibration reduction techniques can be achieved. Vibration control is further enhanced by use of a separate, low distortion amplifier for exclusively amplifying the output of the vibration reduction circuit 76, while the higher power main drive signal is amplified by an efficient PWM type amplifier.

As will be appreciated, the foregoing vibration reduction techniques can contribute to improved performance of the cooled device. For example, line-of-sight accuracy of infrared sensors deployed on spacecraft is a parameter that is closely linked to vibrational disturbances. Using the vibration reduction techniques described herein, line-of-sight accuracy of infrared sensors can be improved. This enables high precision pointing and low-jitter imaging, there by extending the utility of the linear cryocooler technology to meet demands of advanced space and earth bound sensors. With the low vibration cooling techniques and the apparatus described herein one may use linear coolers on extremely sensitive optical instruments that previously could not be cooled in this manner due to vibrational disturbance. In the past, other cooling techniques that involved heavier and/or more power consuming systems, such as turbo-Brayton systems or a passive radiator, were used to cool these ultra-vibration sensitive sensor assemblies.

Although particular embodiments of the invention have been described in detail, it is understood that the invention is not limited correspondingly in scope, but includes all changes, modifications and equivalents coming within the spirit and terms of the claims appended hereto.

What is claimed is:

1. A linear oscillating cryocooler comprising:

a first motor that drives axial linear movement of a first linear oscillating mass, the first motor having a main drive winding and a separate trim winding separate from the main drive winding, the main drive winding being driven and arranged to cause linear oscillation of the first mass, the separate trim winding being driven and arranged to provide either an increased or decreased amount of controlled linear movement of the first mass so as to reduce a vibration of the first motor;

a second motor that drives linear movement of a second linear oscillating mass using at least one winding of the second motor, wherein one of the first mass or the second mass is a balancer for the other of the first mass or the second mass; and a motor controller that outputs a main drive signal that is coupled to the main drive winding, and a separate vibration reducing signal that is coupled to the separate trim winding, wherein a collective effect of the main drive signal on the main drive winding and the vibration reducing signal on the separate trim winding moves the first mass so that the first mass moves in a counter-balancing manner relative to movement of the second mass, and the first mass has reaction against inertia of the second mass to reduce vibration of the cryocooler assembly as a whole.

2. The cryocooler according to claim 1, wherein the main drive winding and the trim winding have separate magnetic gaps with respect to the first motor.

3. The cryocooler according to claim 1, wherein the trim winding is wound on top of or under the main drive winding.

4. The cryocooler according to claim 1, wherein the first mass driven by the first motor is a displacer for effectuating cooling of a cooled device.

5. The cryocooler according to claim 1, wherein the first mass driven by the first motor balances movement of a displacer moved by the second motor, the displacer being the second mass.

6. The cryocooler according to claim 1, wherein the cryocooler cools an optical sensor.

7. The cryocooler according to claim 6, wherein the sensor is mounted on a spacecraft.

8. The cryocooler according to claim 1, wherein the main drive signal and the vibration reducing signal each have a current step size and a ratio of the current step size of the main drive signal to the current step size of the vibration reduction signal is in the range of about 1:0.005 to about 1:0.1.

9. The cryocooler according to claim 1, wherein the controller receives an output of a temperature sensor arranged to sense a temperature of an object to be cooled, executes a temperature control algorithm using the output of the temperature sensor, and amplifies an output of the temperature control algorithm with a pulse width modulation amplifier to generate the main drive signal.

10. The cryocooler according to claim 1, wherein the controller receives a vibration feedback signal from a vibration sensor, processes the vibration feedback signal to generate a vibration-canceling waveform and amplifies the vibration-canceling waveform with a linear amplifier to generate the vibration reduction signal.

11. The cryocooler according to claim 10, wherein the linear amplifier is an analog amplifier.

12. A method of reducing vibration in a linear oscillating cryocooler having a first motor that drives axial linear movement of a first linear oscillating mass and a second motor that drives linear movement of a second linear oscillating mass, the method comprising:

generating a main drive signal and coupling the main drive signal to a main drive winding of the first motor;

generating a vibration reducing signal separate from the main drive signal;

coupling the vibration reducing signal to a separate trim winding of the first motor that is separate from the main drive winding, the separate trim wind being driven and arranged to provide either an increased or decreased amount of controlled linear movement of the first mass so as to reduce a vibration of the first motor, wherein the main drive winding drives linear oscillation of the first mass; and generating a drive signal for the second motor and coupling the drive signal for the second motor to a winding of the second motor to drive linear movement of the second mass;

wherein one of the first mass or the second mass is a balancer for the other of the first mass or the second mass;

wherein a collective effect of the main drive signal on the main drive winding and the vibration reducing signal on the trim winding moves the first mass so that the first mass moves in a counter-balancing manner relative to movement of the second mass, and the first mass has reaction against inertia of the second mass to reduce vibration of the cryocooler assembly as a whole.

13. The method according to claim 12, wherein the main drive winding and the trim winding have separate magnetic gaps with respect to the first motor.

14. The method according to claim 12, wherein the trim winding is wound on top of or under the main drive winding.

15. The method according to claim 12, further comprising cooling a device with the cryocooler.

16. The method according to claim 15, wherein the cooled device is an optical sensor.

17. The method according to claim 16, wherein the sensor is mounted on a spacecraft.

18. The method according to claim 12, wherein the main drive signal is generated by executing a temperature control algorithm using an output of a temperature sensor arranged to sense a temperature of an object to be cooled and amplifying an output of the temperature control algorithm with a pulse width modulation amplifier.

19. The method according to claim 12, wherein the vibration reduction signal is generated by processing a vibration feedback signal received from a vibration sensor coupled to the first motor to generate a vibration-canceling waveform, and amplifying the vibration-canceling waveform with a linear amplifier.

20. The cryocooler according to claim 1, wherein the first mass driven by the first motor and the second mass driven by the second motor are each in a compressor of the cryocooler.

21. The cryocooler according to claim 1, wherein the controller generates the main drive signal as a function of a sensed temperature of a part to be cooled by the cryocooler, and the controller generates the trim winding signal as a function of a sensed vibration of the cryocooler independent of the sensed temperature.

22. The cryocooler according to claim 1, wherein the main drive winding and the trim winding are physically linked to the first mass and move with the first mass relative to movement of the second mass.

23. The method according to claim 12, wherein the main drive signal is generated as a function of a sensed temperature of a part to be cooled by the cryocooler, and the trim winding signal is generated as a function of a sensed vibration and independent of the sensed temperature.

24. The method according to claim 12, wherein the main drive winding and the trim winding are physically linked to the first mass and move with the first mass relative to movement of the second mass.

25. The method of claim 12, wherein the main drive signal and the vibration reducing signal each have a current step size, and a ratio of the current step size of the main drive signal to the current step size of the vibration reduction signal is in the range of about 1:0.005 to about 1:0.1, wherein the main drive signal is amplified by a pulse width modulation (PWM) amplifier, and the vibration reduction signal is amplified by a linear amplifier, said linear amplifier being configured to reduce vibration degradation that would be presented by use of a PWM amplifier to amplify the vibration reduction signal, said vibration degradation including total harmonic distortion, amplifier resolution, and crossover distortion such that, in combination with the ratio of the current step size of the main drive signal to the current step size of the vibration reduction signal, at least a two order of magnitude improvement in vibration reduction is achieved, as measured with respect to a conventional vibration reduction technique.

26. The cryocooler of claim 8, wherein the main drive signal is amplified by a pulse width modulation (PWM) amplifier, and the vibration reduction signal is amplified by a linear amplifier, said linear amplifier being configured to reduce vibration degradation that would be presented by use of a PWM amplifier to amplify the vibration reduction signal, said reduced vibration degradation including reducing one or more of a total harmonic distortion, an amplifier resolution, and crossover distortion such that, in combination with the ratio of the current step size of the main drive signal to the current step size of the vibration reduction signal, at least a two order of magnitude improvement in vibration reduction is achieved, as measured with respect to a conventional vibration reduction technique.

27. The method of claim 12, further comprising providing a current step size of the main drive signal that is at least an order of magnitude greater than a current step size of the vibration reducing signal.

28. The cryocooler of claim 1, wherein a current step size of the main drive signal is at least an order of magnitude greater than a current step size of the vibration reducing signal.

* * * * *